US005182416A

United States Patent [19]

Schweizer

[11] Patent Number: 5,182,416

[45] Date of Patent: Jan. 26, 1993

[54] APPARATUS FOR CONNECTING A SET OF PERCUSSION INSTRUMENTS TO A MIXING DESK

[76] Inventor: Harald Schweizer, 6711 Yucca St. #315, Hollywood, Calif. 90028

[21] Appl. No.: 829,395

[22] Filed: Feb. 3, 1992

Related U.S. Application Data

[63] Continuation of Ser. No. 575,145, Aug. 29, 1990, abandoned.

[51] Int. Cl.[5] ..... G10D 13/02; G10D 15/00; G10H 3/00

[52] U.S. Cl. ..... 84/723; 84/421; 84/DIG. 12

[58] Field of Search ..... 84/723, 737, 743, 412, 84/421, DIG. 12

[56] References Cited

U.S. PATENT DOCUMENTS

| | | | |
|---|---|---|---|
| 3,551,580 | 12/1970 | Glenn | 84/421 |
| 3,974,732 | 8/1976 | Kester, Jr. | 84/421 |
| 4,691,611 | 9/1987 | May | 84/421 |
| 4,903,570 | 2/1990 | Sassmannshausen et al. | 84/421 |
| 5,063,821 | 11/1991 | Battle | 84/723 |

*Primary Examiner*—William M. Shoop, Jr.
*Assistant Examiner*—Helen Kim
*Attorney, Agent, or Firm*—Bachman & LaPointe

[57] ABSTRACT

An apparatus for electronically connecting a plurality of percussion instruments having individual connecting leads to a mixing desk or the like comprises a rack surrounding at least partially the plurality of percussion instruments wherein the rack is provided with sockets for receiving the individual connecting leads from each of the percussion instruments and is further provided with a single connection cable for connecting the rack to the mixing desk.

7 Claims, 1 Drawing Sheet

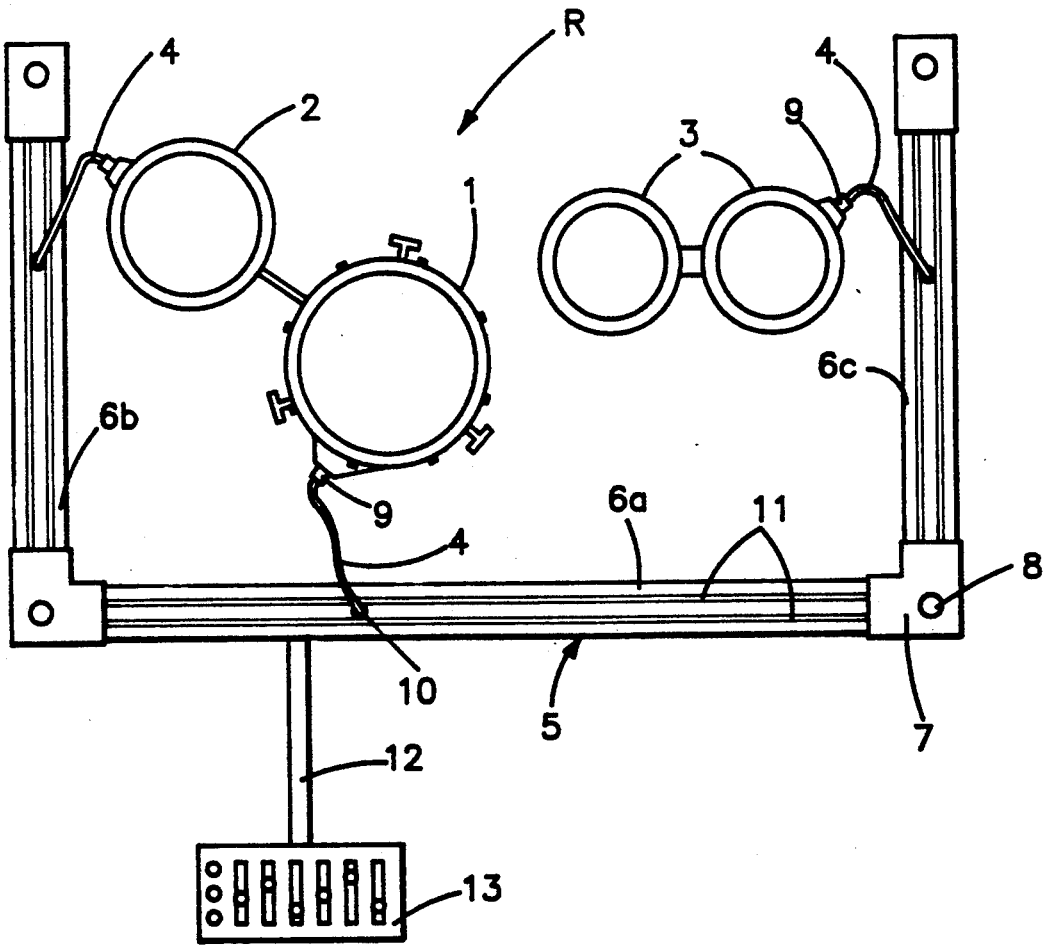
R
4
2
1
3
9
4
6c
6b
9
4
6a
11
8
10
5
7
12
13

APPARATUS FOR CONNECTING A SET OF PERCUSSION INSTRUMENTS TO A MIXING DESK

RELATED APPLICATIONS

This application is a continuation of U.S. patent application Ser. No. 07/575,145, filed Aug. 29, 1990, and now abandoned.

BACKGROUND OF THE INVENTION

The present invention relates to an apparatus for connecting a plurality of percussion instruments to an amplifier, a mixing desk or the like.

Nowadays, percussion instruments are normally amplified electronically which requires each instrument to be coupled to a corresponding amplifier or mixing desk. In order to couple each instrument to an amplifier, cable leads are required to connect each instrument of the plurality of percussion instruments to its corresponding amplifier. In light of the foregoing, a considerable amount of effort has to be expended when the instruments are set up.

In addition to the foregoing a "tangle of cables" results, which is very unsightly and quite dangerous. On one hand, the "tangle of cables" may well result in someone being tripped while on the other hand the cables themselves may be damaged which would impair the acoustic performance of the set of percussion instruments.

Accordingly, it is the principal object of the present invention to develop an apparatus whereby the mentioned disadvantages are overcome and where the connection between a plurality of percussion instruments and an amplifier or mixing desk is considerably improved.

SUMMARY OF THE INVENTION

The foregoing object is achieved by way of the present invention wherein a rack is arranged at least partially around the plurality of percussion instruments and the individual instruments are connected via leads to the rack and the rack in turn is connected with the amplifier via a single connection lead.

As a result of the foregoing, the wiring of a plurality of percussion instruments to an amplifier or the like is made considerably easier by way of the rack. The corresponding connecting leads of each instrument are routed only from the instrument to the rack. Furthermore, routing takes place from the rack by a common connection lead to the amplifier or mixing desk device.

As a result, the combination of acoustic pickup and electronic control is optimized. The saving on cable material is likely to be over 50%. Faults which occur due to tripping over cables or disconnecting cables no longer occur as the "tangle of cables" is eliminated.

Of particular importance is the reduction in the set up and dismantling time which is reduced by more than 50%. In addition, there is a visual improvement which has particular advantages in the case of TV appearances and live events.

In accordance with the present invention, the rack preferably comprises individual profiled strips connected together and these may be of any length depending on size requirements to partially surround the plurality of instruments. As a result, sufficient allowance can be made for any arrangement and any sized set of percussion instruments.

The profiled strips are preferably interconnected via corner pieces through which uprights or legs pass. As a result, a self-supporting structure is created.

The connection between the individual instrument connecting leads and the single connection lead to the amplifier is made, as mentioned above, via the rack (the profiled strips) so that there is no longer any "tangle of cables". In accordance with a further feature of the present invention, the corresponding plugs of the connecting leads are to be designed in such a way that they can be displaced along the respective profiled strip. The foregoing makes it possible to have the shortest connection between each instrument and the rack.

BRIEF DESCRIPTION OF THE DRAWINGS

Further advantages, features and details of the present invention will be made clear with reference to the drawing which shows a plan view of a plurality of percussion instruments set up for use with the rack of the present invention.

DETAILED DESCRIPTION

With reference to the FIGURE, a plurality of percussion instruments including a tom-tom 1, a small drum 2 and timbals 3 are schematically illustrated. Naturally, other percussion instruments may be provided, such as for example, a foot-operated big drum, a hi-hat, a cymbal or the like.

Each of these instruments 1, 2 or 3 has a connecting lead 4 to a rack 5. The rack 5 comprises a plurality of profiled strips 6 connected together. In the illustrated example, one profiled strip **6*a* is arranged in front of the plurality of percussion instruments R while lateral profiled strips 6*b* and 6*c* form side limitations. The profiled strips 6 are interconnected via corner pieces 7, through which uprights or legs 8** pass. In this way, a self-supporting framework is produced.

Each connecting lead 4 has on one end a connection plug 9 for connecting a respective instrument 1, 2 or 3 and on the other end a plug 10 for connecting to the profiled strips 6.

Preferably the plug 10 is designed so as to be displaceable along the profiled strips 6, for which purpose guide rails 11 are provided on the strips.

Routing of the connecting leads 4 takes place inside the profiled strips 6 to a single outgoing cable 12 which connects the rack 5 to an amplifier or mixing desk 13.

What is claimed is:

1. An apparatus for electronically connecting a plurality of percussion instruments having individual connecting leads to a mixing desk which comprises: rack means surrounding at least partially the plurality of percussion instruments, said rack means having socket means for electronically connecting the individual connecting leads from each of said percussion instruments to said rack, means and a single connection cable for electronically connecting said rack means to said mixing desk.

2. An apparatus according to claim 1 wherein said rack means comprises a plurality of individual profiled strips.

3. An apparatus according to claim 2 wherein the plurality of individual profiled strips are interconnected via corner pieces.

4. An apparatus according to claim 3 wherein the corner pieces are provided with upright means for forming a self-supporting framework.

5. An apparatus according to claim 1 wherein said socket means comprises a continuous guide rail extending substantially the entire length of said rack means.

6. An apparatus according to claim 2 wherein each of the individual profiled strips includes socket means which extends along each profiled strip substantially the entire length thereof.

7. An apparatus for electronically connecting a plurality of percussion instruments having individual connecting leads to a mixing desk, which comprises: rack means surrounding at least partially the plurality of percussion instruments, said rack means having socket means for electronically connecting the individual connecting leads from each of said percussion instruments to said rack, means and a single connection cable for electronically connecting said rack means to said mixing desk, said socket means being mounted on a continuous guide rail extending substantially the entire length of said rack means, whereby said socket means can be displaced along said rack to provide a shortest connection between each instrument and said rack.

* * * * *